United States Patent [19]

Pozzobon

[11] Patent Number: 4,519,149

[45] Date of Patent: May 28, 1985

[54] DEVICE FOR ADJUSTING THE FLEX IN REAR-ENTRY SKI BOOTS

[75] Inventor: Alessandro Pozzobon, Treviso, Italy

[73] Assignee: Nordica S.p.A., Montebelluna, Italy

[21] Appl. No.: 408,318

[22] Filed: Aug. 16, 1982

[30] Foreign Application Priority Data

Aug. 31, 1981 [IT] Italy ..... 22767/81[U]

[51] Int. Cl.[3] ..... A43B 5/04

[52] U.S. Cl. ..... 36/121; 36/105

[58] Field of Search ..... 36/105, 117–121

[56] References Cited

U.S. PATENT DOCUMENTS 4,222,184 9/1980 Kastinger ..... 36/121

4,265,034 5/1981 Salomon ..... 36/105

FOREIGN PATENT DOCUMENTS 2808805 6/1979 Fed. Rep. of Germany ..... 36/121

*Primary Examiner*—James Kee Chi

*Attorney, Agent, or Firm*—Guido Modiano; Albert Josif

[57] ABSTRACT

The device comprises a settable elastic U-like link element housed in a receiving seat defined in the rear cuff of the ski boot and coupled to an engagement element protruding from the seat and adapted to engage, with the rear cuff in the closed position, with a retaining element provided rearwardly on the shell of the ski boot.

6 Claims, 4 Drawing Figures

DEVICE FOR ADJUSTING THE FLEX IN REAR-ENTRY SKI BOOTS

BACKGROUND OF THE INVENTION

This invention relates to a device for adjusting the flex, particularly in rear-entry ski boots.

As is known, ski boots have long been equipped with devices allowing the amount of flex thereof to be adjusted, that is, for adjusting the bias action applied by the cuff in skiing practice.

Various types of devices are currently in use, for flex adjustment, which generally comprise a settable elastic means connected between the shell and cuff of the boot to enable the user to vary the elastic bias as desired.

This type of a device is not, however, applicable on rear-entry ski boots, wherein the rear cuff must be left free to pivot out such that the boot can be worn, since such devices would hamper the user during the boot putting on operation.

SUMMARY OF THE INVENTION

Accordingly the task of this invention is to provide a device for adjusting the flex of a ski boot, which is specially conceived for use with rear-entry ski boots, wherein the device itself would not hamper the user in putting on the ski boots, and which is so set up as to require no special or complex handling to put the boots on.

Within this task it is an object of the invention to provide a device which is constructionally simple and effective to be practically accommodated within the boot such as to be adequately protected, while skiing, against possible seepage or admission of foreign matter which may interfere with or otherwise affect the correct operation of the device.

Another object of the invention is to provide a device which, owing to its constructional features, can be fully reliable and safe to use.

According to one aspect of the present invention the above task and objects as well as yet other objects, such as will be apparent hereinafter, are achieved by a device for adjusting the flex, particularly in rear-entry ski boots, characterized in that it comprises, within a receiving seat defined in the rear cuff of a ski boot, settable elastic means connected to an engagement element protruding out of said receiving seat, said engagement element being adapted to engage, with said rear cuff in the closed position, with a retaining element provided rearwardly on the shell of said ski boot.

BRIEF DESCRIPTION OF THE DRAWING

Further features and advantages will be more apparent from the following detailed description of a device for adjusting the flex, particularly in rear-entry ski boots, as illustrated by way of example and not of limitation in the accompanying drawing, where.

DESCRIPTION OF THE PREFERRED EMBODIMENTS

Figure 2:
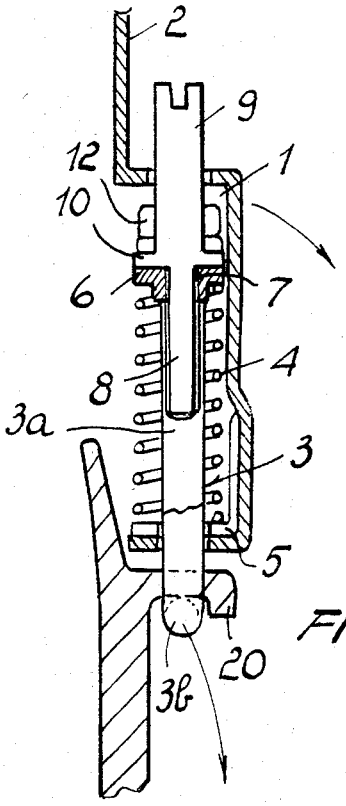
FIG. 2 is a longitudinal section view of the device of this invention, with the cuff in its closed position.

Making reference to the cited figures, this device for adjusting the flex, particularly in rear-entry ski boots, comprises a shape seat 1 which is defined close to the bottom end of the rear cuff 2.

Inside said receiving seat 1, there are provided settable elastic means which, in this instance, include a link 3 of substantially U-like shape and having its arms 3*a* accommodated within the seat 1, and the arm interconnecting portion thereof, 3*b*, located externally of the seat and protruding below the bottom end of the cuff 2.

On the arms 3*a* of the link element 3, there are provided cylindrical coil springs 4 which act, with their bottom ends, on the base of the seat 1, and precisely on a metal reinforcement 5 attached to the seat itself, whilst with their top ends, the coil springs 4 act on a setting plate 6, which has at its center a threaded seat 7 wherein a threaded shank 8 of an adjusting pin 9, protruding up from the seat 1 and having at a middle portion thereof a flange formation 10 adapted to abut against an abutment plate 11 which is located below bolts 12 mounted on the free ends of the arms 3*a*, can be engaged rotatably.

A peculiar feature of the invention is that the arm interconnecting portion 3*b* forms an engagement element adapted to engage with a retaining element 20 provided rigid with the rear portion of the shell 21. The retaining element 20 has a downwardly open hooked configuration, whereby it allows the interconnecting portion 3*b* to disengage automatically as the rear cuff is pivoted rearwards to open the boot, and to automatically engage the portion 3*b* as the cuff is moved into its closed position.

Figure 4:
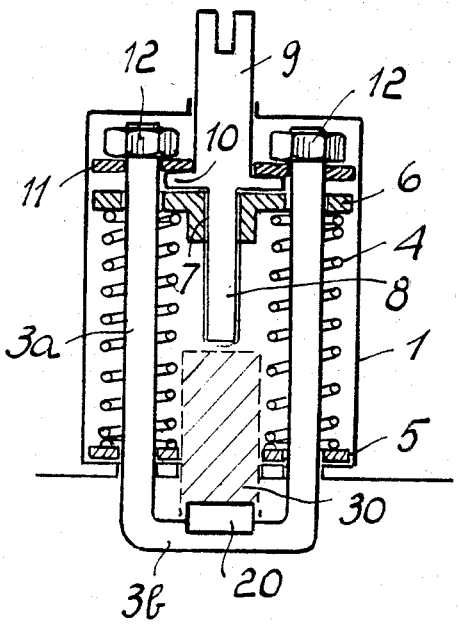
FIG. 4 shows schematically a front view of the device.
Figure 3:
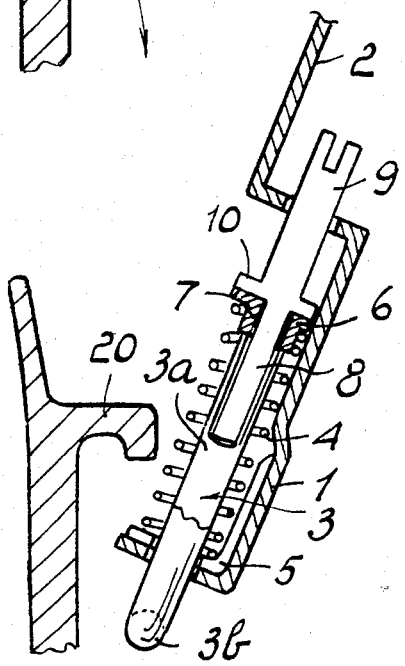
FIG. 3 is a sectional view of the device with the cuff in its open position.
Figure 1:
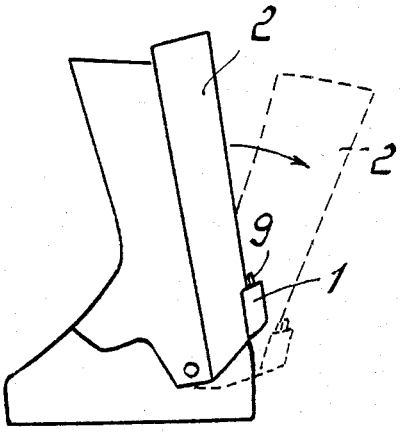
FIG. 1 shows schematically the device of this invention as applied on a rear-entry ski boot.

To this aim, the device is provided with an unobstructed area 30, shown in dash lines in FIG. 4, in the seat 1, which is effective to allow the retaining element 20 freely through the device as the cuff is pivoted.

The device utilization is quite simple and partly evident from the foregoing description. In fact, with the cuff 2 in the closed position, any forward lean movements become feasible by overcoming the elastic bias of the springs 4, which will be compressed between the setting plate 10 and reinforcement plate 5. In order to change the amount of flex in the boot as desired, the pin 9 is manipulated to produce, by virtue of the threaded pin 8, a translation of the plate 6, and accordingly a variation in the spring preloads.

When the boot is to be put on, by pivoting the rear cuff out, the retaining element is caused to disengage from the interconnecting portion 3*b*, thus allowing the boot to be opened, with the added advantage that the device, being carried on the cuff itself, will in no way interfere.

By closing the cuff back, the retaining element 20 is practically caused to slip onto the interconnecting portion 3*b*, thus re-establishing the connected condition and allowing in consequence the cuff to be swung with respect to the shell by merely overcoming the bias force of the elastic means.

It will be appreciated from the foregoing that the invention achieves its objects, and in particular that the device construction is simple, while it interferes in no way with the unimpeded rearward pivoting of the rear cuff to put the ski boot on.

In practicing the invention, the materials used, if compatible with the specific application contemplated, as well as the dimensions and contingent shapes, may be any suitable ones meeting individual requirements.

I claim:

1. A device for adjusting the flex, particularly in rear-entry ski boots comprising within a receiving seat defined in the rear cuff of a ski boot settable elastic means connected to an engagement element protruding out of said receiving seat, said engagement element being adapted to engage, with said rear cuff in the closed position, with a retaining element provided rearwardly on the shell of said ski boot, wherein said engagement element is defined by the interconnecting portion of the arms of a substantially U-like link element accomodated inside said receiving seat and having coil springs arranged at the arms thereof, said coil springs acting between a reinforcement plate provided at the inside bottom of said receiving seat and a setting plate slidably supported on said arms of said link element, said setting plate having at a middle portion thereof a threaded hole wherein there engages a threaded shank defined at the bottom end of an adjusting pin protruding up from said receiving seat, wherein said adjusting pin has at a middle portion thereof a flange formation adapted to abut against a stop plate provided at the free top ends of said arms and secured thereon by locknuts mounted on the free ends of said arms of said link element.

2. A device for adjusting the flex, particularly in rear-entry ski boots, according to claim 1, characterized in that said retaining element has a downwardly open hooked configuration.

3. A device for adjusting the flex, particularly in rear-entry ski boots, according to claim 1, characterized in that it is formed, at the bottom portion thereof, with a cutout adapted to allow said retaining element therethrough as said rear cuff is pivoted to open and close.

4. In a rear-entry ski boot including a rear cuff member pivotally mounted on a rear portion of the ski boot shell, a device for biasing the forward lean movement of the ski boot, comprising a seat on said rear cuff member, an engagement element movably located in said seat and having a portion thereof protruding out of said seat, spring means in said seat for biasing said engagement element into its retracted position, and a retaining element on said rear portion of the ski boot shell adapted for releasable engagement with said protruding portion of said engagement element, thereby said spring means resiliently opposing said engagement element to be entrained into its extended position by said retaining element when forward lean of the ski-boot is exerted and resiliently urging said engagement element into its retracted position.

5. A device according to claim 4, further comprising adjusting means for adjusting the bias of said spring means.

6. A device according to claim 4, wherein said retaining element disengages from said engagement element, as said rear cuff member is pivoted to open, and engages with said retaining element as said rear cuff member is pivoted to close.

* * * * *